US008851192B2

(12) United States Patent
Deible et al.

(10) Patent No.: US 8,851,192 B2
(45) Date of Patent: Oct. 7, 2014

(54) METHOD AND APPARATUS FOR FORMING A TUBULAR CONDUIT

(75) Inventors: Charles Deible, Katy, TX (US); Eric Lavrut, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 580 days.

(21) Appl. No.: 13/128,668

(22) PCT Filed: Dec. 1, 2009

(86) PCT No.: PCT/EP2009/008656

§ 371 (c)(1), (2), (4) Date: Aug. 1, 2011

(87) PCT Pub. No.: WO2010/069477

PCT Pub. Date: Jun. 24, 2010

(65) Prior Publication Data

US 2011/0277299 A1 Nov. 17, 2011

(30) Foreign Application Priority Data

Dec. 19, 2008 (EP) ..... 08172440

(51) Int. Cl.
*E21B 19/16* (2006.01)
*E21B 43/10* (2006.01)

(52) U.S. Cl.
CPC ..... *E21B 43/103* (2013.01)
USPC ..... 166/380; 166/381; 166/77.2; 29/700; 29/428

(58) Field of Classification Search
CPC ..... E21B 43/10; E21B 43/103; E21B 7/20; E21B 19/22; E21B 17/20; B21C 37/00
USPC ..... 166/382, 385, 77.1, 77.2, 380; 29/428, 29/700
See application file for complete search history.

(56) References Cited

U.S. PATENT DOCUMENTS 5,169,264 A 12/1992 Kimura
6,679,334 B2 * 1/2004 Johnson et al. ..... 166/380

FOREIGN PATENT DOCUMENTS

DE 1189492 3/1965
WO 02/25057 3/2002
WO 2008/006841 1/2008

OTHER PUBLICATIONS

Search Report from the equivalent European patent application No. 09768498.9 issued on Apr. 18, 2012.

* cited by examiner

*Primary Examiner* — Yong-Suk (Philip) Ro
(74) *Attorney, Agent, or Firm* — Stephanie Chi; Jody DeStefanis

(57) ABSTRACT

A method of forming a tubular conduit in a borehole, wherein the borehole is closed by means of a pressure barrier capable of sustaining a borehole pressure and having at least one pressure sealable inlet, comprises:

introducing a substantially flat, elongate flexible member into the borehole; and forming the flexible member into a tubular form to define the conduit inside the borehole below the pressure barrier. An apparatus for forming a tubular conduit in a borehole closed by a pressure barrier capable of sustaining a borehole pressure and having at least one pressure sealable inlet, comprises:

a supply of a substantially flat, elongate flexible member;

a feed system for introducing the member into the borehole; and a former below the pressure barrier for forming the flat member into a substantially tubular conduit in the borehole.

15 Claims, 6 Drawing Sheets

METHOD AND APPARATUS FOR FORMING A TUBULAR CONDUIT

TECHNICAL FIELD

This invention relates to methods and apparatus for forming tubular conduits in boreholes such as oil or gas wells. In particular it relates to methods and apparatus operable at borehole pressure.

BACKGROUND ART

At different stages in the life of a producing well it is necessary to perform interventions for repairs or modifications in the producing tubing assembly, modification of the producing zones by perforating or drilling new reservoir zones. These interventions can be performed without killing the well (filling the well with heavy fluids) and with pressure at the well head. A major concern in these types of interventions is to safely contain the well head pressure while deploying the interventions tools.

During interventions in producing wells, several interventions are usually done to maintain the producing tubing assembly, as for:

cleaning of the well bore
pumping of stimulation or cleaning fluids
milling restrictions
operations or repairs of valves.

To enhance production, more zones of the reservoir can be put to production by perforating new zones
drilling lateral drain holes It is often required to perform these interventions without killing the well to avoid damage to producing zones by invasion of killing fluids. This implies to keep the well under balanced or near balanced with produced fluids, gas or light fluids. This means that pressure will continually be present at the well head during the deployment, operation and retrieval of the downhole tools, umbilical and wireline cable.

Flow conduits used during interventions in underbalanced wells need to be designed following requirements for downhole operations, for example small cross section, resistance to wear, temperature and pressure, etc. However, deploying flow conduits under pressure requires the flow conduit to withstand large differential pressures, snubbing into a pressure barrier to overcome the effect of the pressure on the presented surface area, large buckling forces or large tensile forces, large gripping forces to prevent ejection from the well and coiling for relatively compact storage and transportation. These design requirements are difficult to satisfy completely because of the large safety coefficient required for surface equipment under pressure is often contradictory the requirements for downhole operation.

One existing means to perform these types of interventions is coil tubing, but this involves the use of very large and expensive surface equipment such as injectors and strippers. Also the safety coefficient for coil tubing is low and it is not widely accepted to circulate well fluids to surface with coil tubing. Very high stresses in coil tubing during deployment can lead to fatigue and possible failures not compatible with safe operation under pressure at surface. Another existing means to perform these types of interventions is pipe snubbing, but this system has several limitations in terms of time performance or safety.

Both coil tubing and pipe snubbing use existing tubular conduits. U.S. Pat. No. 6,217,975 describes a technology for the construction of tubular conduits from elongate strips of flexible material. These a rolled axially and the long edges joined to form a tubular conduit. U.S. Pat. No. 6,431,271 describes various uses for such a system in a wellbore environment.

It is the purpose of this invention to allow safe deployment and retrieval of a tool string, cable and flow conduit with formation induced well pressure at the well head using a compact and easily transportable system. This is achieved by forming the tubular conduit under borehole pressure, such as inside the wellhead system.

DISCLOSURE OF THE INVENTION

A first aspect of this invention provides a method of forming a tubular conduit in a borehole, wherein the borehole is closed by means of a pressure barrier capable of sustaining a borehole pressure and having at least one pressure sealable inlet through which a tool conveyance means, such as a wireline cable, can be inserted, the method comprising:

introducing a substantially flat, elongate flexible member into the borehole; and
forming the flexible member into a tubular form to define the conduit inside the borehole below the pressure barrier adjacent the conveyance.

Preferably, the method comprises progressively forming the conduit as the flexible member is introduced into the borehole.

The method can further comprise attaching an end of the formed conduit to a tool suspended in the borehole on the conveyance means. In this case, the method typically includes lowering the tool in the borehole on the conveyance means, and forming the conduit around the conveyance means as the tool is lowered.

When subsequently withdrawing the conduit from the borehole, the method can further include opening the tubular formed member into a substantially flat form and withdrawing it from the borehole.

The flexible member can be introduced into the borehole through a pressure-sealable inlet. Alternatively, a supply of the flat flexible member is provided in an environment at borehole pressure that is connected to the borehole.

A second aspect of the invention provides apparatus for forming a tubular conduit in a borehole closed by a pressure barrier capable of sustaining a borehole pressure and having at least one pressure sealable inlet through which a tool conveyance means can be inserted, comprising:

a supply of a substantially flat, elongate flexible member;
a feed system for introducing the member into the borehole; and
a former below the pressure barrier for forming the flat member into a substantially tubular conduit in the borehole adjacent the conveyance means.

The former preferably comprises a forming die that is exposed to borehole pressure. The supply of the flexible member can also exposed to borehole pressure. In one alternative, the supply is enclosed in a chamber that also includes the former. In another, the supply is located in a housing at borehole pressure and connected to the borehole by means of a pressurised guide.

A pressure sealable inlet can be provided for introducing the flat member into the borehole.

The apparatus preferably further comprises means for opening the tubular conduit into a substantially flat form in which it can be withdrawn from the borehole.

A tool can be provided in the borehole supported by a conveyance means, the tubular conduit being connected at one end to the tool.

Further aspects of the invention will be apparent from the following description.

MODE(S) FOR CARRYING OUT THE INVENTION

Figure 1:
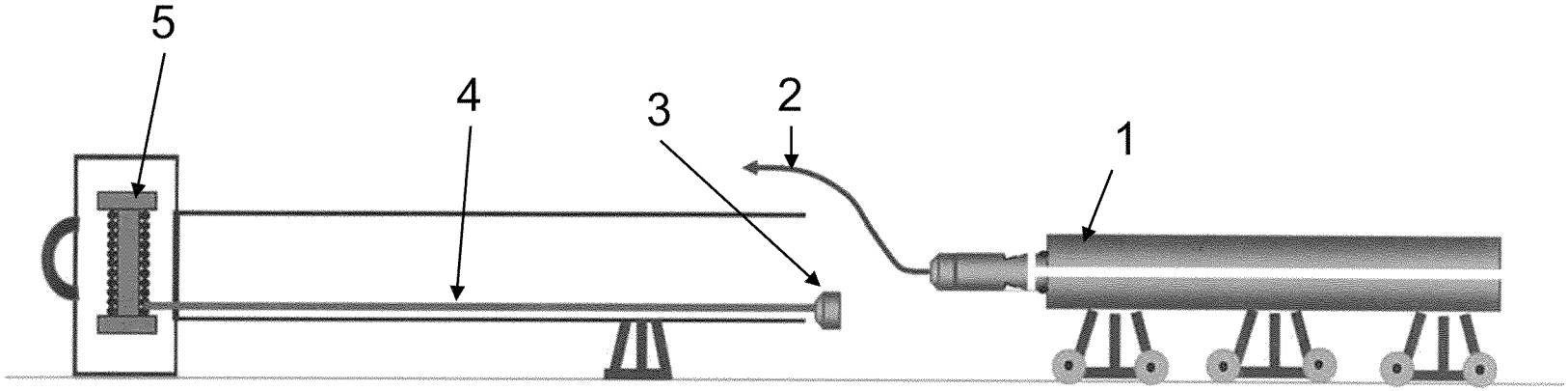
FIGS. 1 and 2 show deployment of a tool into a lubricator.

The present invention can be used to facilitate deployment of a large, heavy wireline tool, its associated cable and a flow conduit into a live well under surface pressure in a safe and efficient manner, while imposing minimal additional requirements on the downhole equipment. This invention provides a flow conduit such that a downhole tool can pump well fluids through the flow conduit and dump or expel the well fluids at any point between the downhole tool and the uphole end of the flow conduit.

The invention is based around the use of a flat, elongate flexible member that can be formed into a tube. U.S. Pat. No. 6,217,975 describes such a system in which the member is made of a composite material which, in its flat form, is stored on a reel. Such a system is known as a bi-stable reeled composite (BRC).

One objective of this invention is to allow a cable to be inserted into a well using standard wireline pressure control techniques. In one alternative form of the invention, the apparatus is located inside the pressure control equipment. A bi-stable reeled composite is wrapped around the wireline cable to from a tube and sealed such that it can withstand internal and external pressure and allow well fluids to flow through it.

The BRC can be sealed using a variety of techniques. The BRC can be designed and manufactured such that it preferentially overlaps itself by an ideal amount when formed into a tube. The preferred technique is to then weld or seal the thermoplastic matrix by heating it close to its melt point and placing the overlapping sections together under pressure.

The tube structure is only formed and sealed once it is contained in the pressure vessel, therefore, the wellhead pressure acts only on the surface area of the flat BRC, and there is not a direct flow conduit through the pressure barrier. The invention eliminates the large snubbing force required to insert a large diameter tube into a live well under pressure. Further the invention increases the safety of pressure control operations by eliminating the passage of flow conduit through a pressure barrier. Flexible tubes with large burst and collapse pressure ratings require safety factors that are incompatible with many downhole operations. Therefore, safety factors, less than those normally accepted for surface pressure control equipment, can be applied to make certain operations, such as injecting coil tubing against well pressure, possible. The invention also eliminates concerns of fatigue associated with coil tubing operations.

To retrieve the downhole tool the tube seam can be deconstructed and the tube retrieved in the way it was inserted or the tube can simply be cut along its axis and discarded as scrap.

Wireline operations with pressure at surface require a lubricator that can contain the entire tool and a grease head that can dynamically seal on the wireline cable. Additionally wireline valves must be provided to close on the wireline cable in emergency or contingency situations such as a lost seal or a stranded armor. The grease head also incorporates features, such as a pack-off, line wiper and head catcher, for other contingency operations. Additionally the top sheave must be supported above all of this equipment and a multitude of control lines must be run from the ground to the grease head. All of the equipment above the wellhead is referred to collectively as wireline pressure control equipment.

Typically workover jobs are done rigless, and thus portable masts or cranes are used to hoist the wireline pressure control equipment over the wellhead. The height of the wellhead plus the length of the wireline pressure control equipment are used to determine the height of the crane or mast required.

For the operations described in the following paragraphs it is not desirable to have the wireline seal, grease head, positioned high above the well head. It is however desired to allow for a safe and efficient rig-up and rig-down of a long tool.

Figure 2:
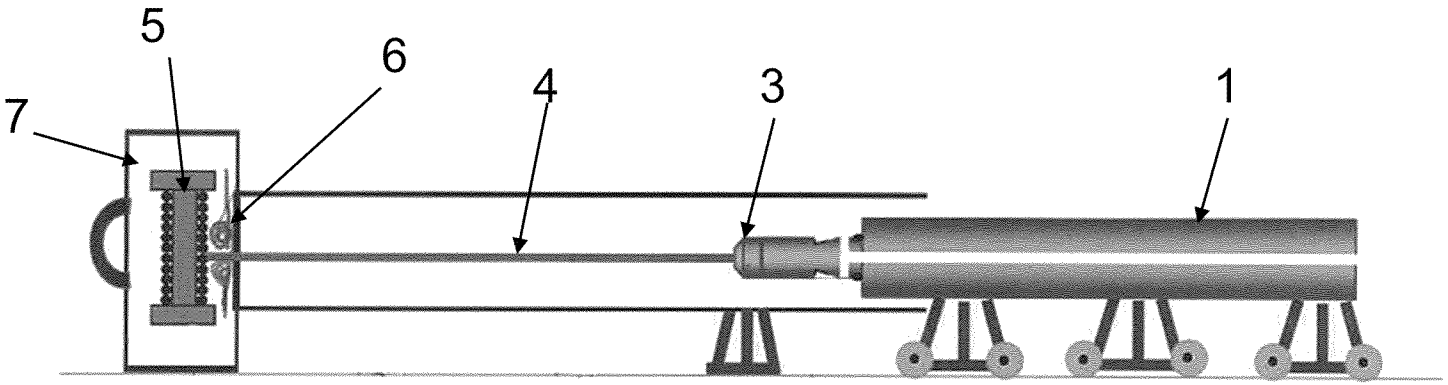

The first step described is deployment of a long heavy tool string. The wireline tool (BHA) 1 is positioned such that it can be connected to a wireline 2 and operationally checked (FIG. 1). After the operational check the tool is connected to an integrated hoisting system consisting of a head connection 3, wire rope 4 and winch 5, and a spooling mechanism 6. The integrated hoist is contained inside a pressure vessel 7 and secured to the top of a lubricator 8 that is of sufficient length to fully enclose the BHA 1 (FIG. 2). The integrated hoist is used to pull the BHA inside the lubricator.

The integrated hoist can also incorporate sensors and safety devices. A position sensor and weight sensor are desirable for some operations that will be described below. The winch 5 can incorporate features to limit the amount of tension that can be generated so that the winch cable 4 does not break. A head catcher can also be used to catch the tool should it be pulled into the top of the lubricator 8 with sufficient force to break the cable 4. The wire rope 4 could be replaced with a section of wireline cable such that the tool 1 can be powered while inside the lubricator 8.

With the tool completely contained inside the lubricator 8 it is possible to pressure test the system. A cap is placed on the bottom of the lubricator 8, the entire vessel filled with water and the system then pressured to the desired test pressure. A quick test sub is employed at the bottom of the lubricator so that the system need not be re-tested when secured to the wellhead later, thus saving time.

Figure 3:
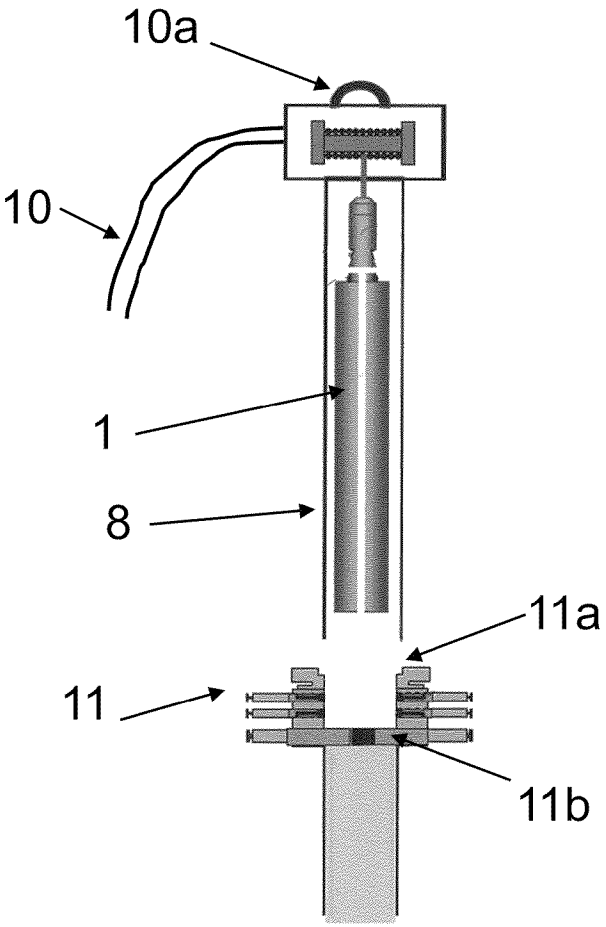
FIG. 3 shows the deployment of the lubricator over a well.

The crane (not shown) is used to pick up the entire assembly over the well head (FIG. 3). The control lines 10 are all below the lift point 10*a*, which is an advantage of the present system over conventional rigless wireline pressure control operations. In conventional operations it is common that the wireline top sheave, the wireline cable and control lines are picked up in one lift and often the wireline cable becomes tangled with the pressure control equipment or control lines while lifting. If it is not possible to untangle the wireline the lift must be laid down and the lifting operation repeated.

Figure 4:
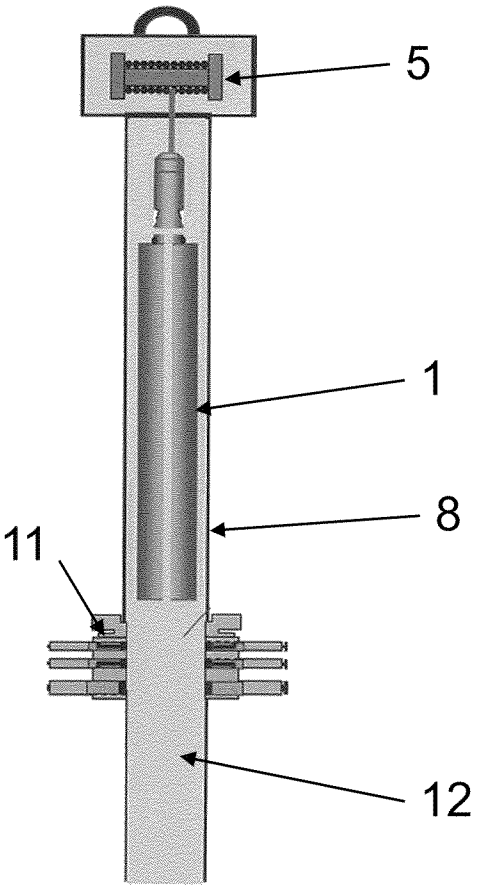
FIG. 4 shows connection of the lubricator to the well.
Figure 6:
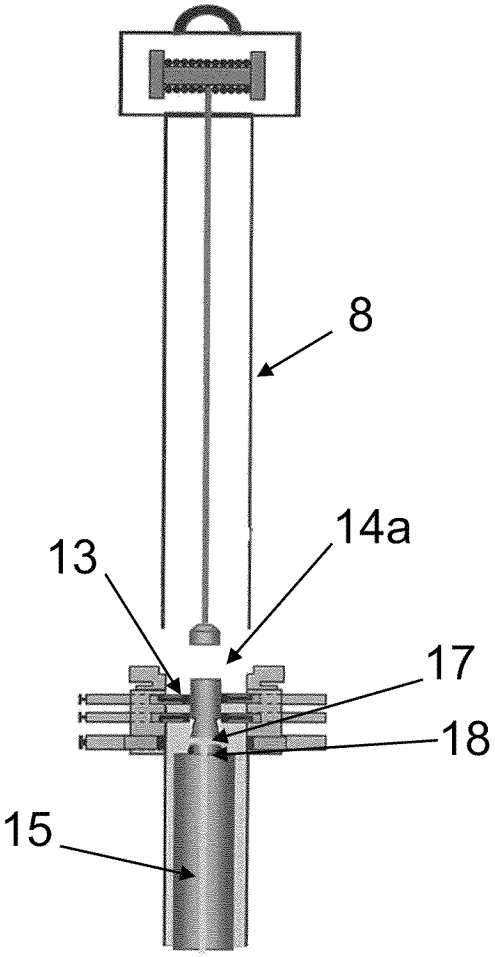
FIG. 6 shows disconnection of the lubricator from the tool.
Figure 5:
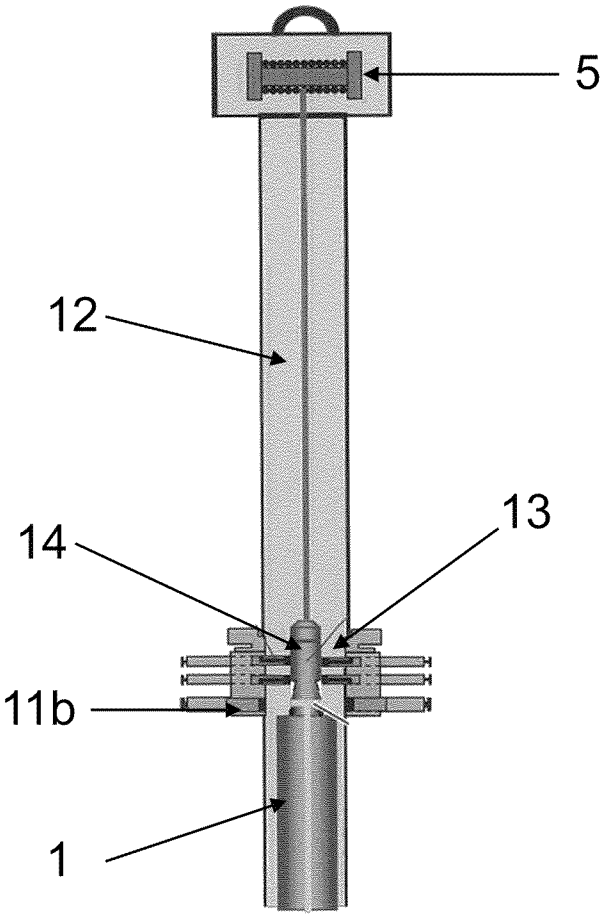
FIG. 5 shows deployment of the toot from the lubricator into the well.

The lubricator 8 is then connected to the deployment stack (11) and the quick test sub (11*a*), if used, pressure tested. The wellhead or master valve 11*b* can then be opened pressurizing the whole system to borehole pressure 12 (FIG. 4). The hoist 5 is now used to lower the BHA 1 into the deployment stack 11 (FIG. 5). A position sensor can be used to ensure accurate placement of the BHA 1 in the deployment stack 11. The deployment stack is then closed 13 on the BHA deployment bar 14 isolating well pressure below the deployment stack. The pressure above the deployment stack is released 14*a*, and the lubricator 8 disconnected from the wellhead and laid down (FIG. 6). If the crane has two winches it is possible to leave the lubricator 8 hanging for subsequent rig down operations.

The BHA 1 may contain a fluid conduit 15 that remains safely below the deployment rams 13. Alternatively the flow conduit can be brought through the deployment rams if a safety valve is incorporated into the BHA. A standard wireline type deployment bar 14 can be used if the flow conduit is left below the deployment rams. The BHA also incorporates features such that a hydraulic wet connect can be securely latched and de-latched to the BHA under pressure in subsequent operations. These features include a mechanical locking collar 17 and pressure seals 18.

Figure 7:
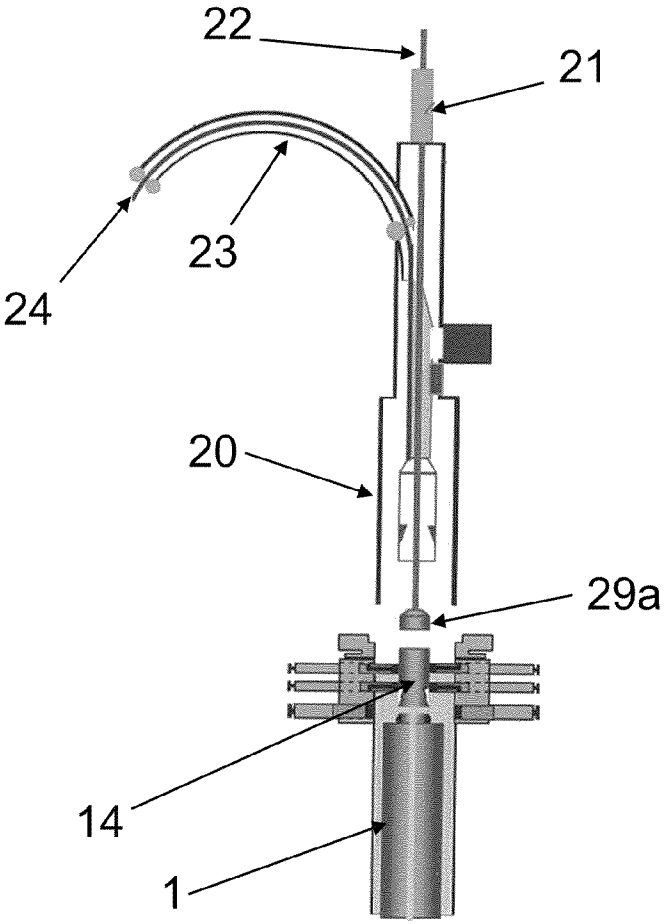
FIG. 7 shows deployment of the deployment head over the well.

The deployment head 20 is then picked up using the crane (FIG. 7). The deployment head 20 incorporates features 21 mentioned earlier to safely seal on a moving or static wireline cable 22. In addition the deployment head is able to seal 23 on a bi-stable reeled composite (BRC) 24. The basic premise of a BRC is that it can be coiled in a compact flattened form and then uncoiled to form a rigid structure, which in this case will be a tube form. The advantage for this application is that it can be inserted into a well against pressure with a low cross sectional area and subsequently formed into a tube. The low cross sectional area, during insertion into the well, dramatically reduces the mechanical requirements of the tube.

The invention can use any structure or device that can be inserted into a well with a low cross sectional area and then formed into a hollow tube with a substantially increased cross sectional area.

Figure 8:
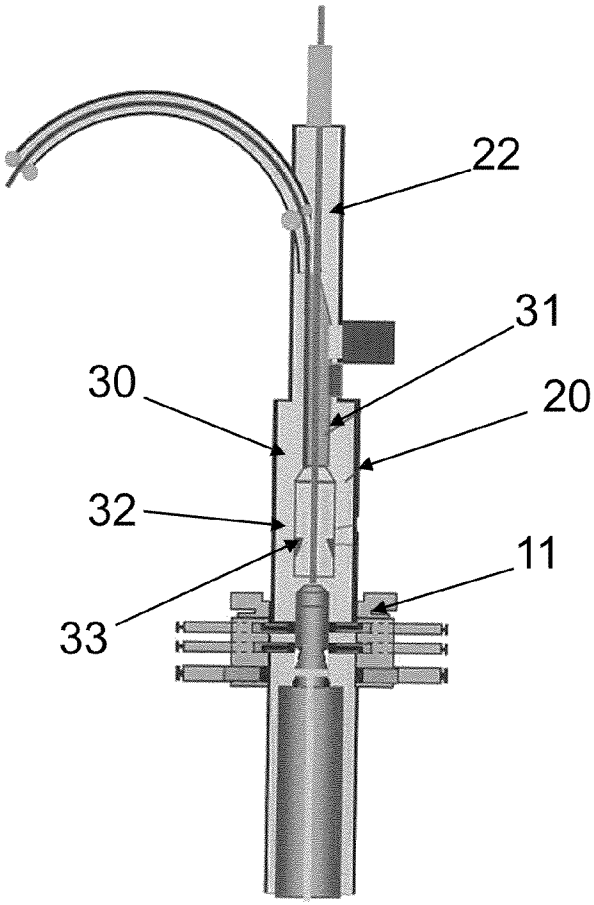
FIG. 8 shows connection of the deployment head to the well head.
Figure 9:
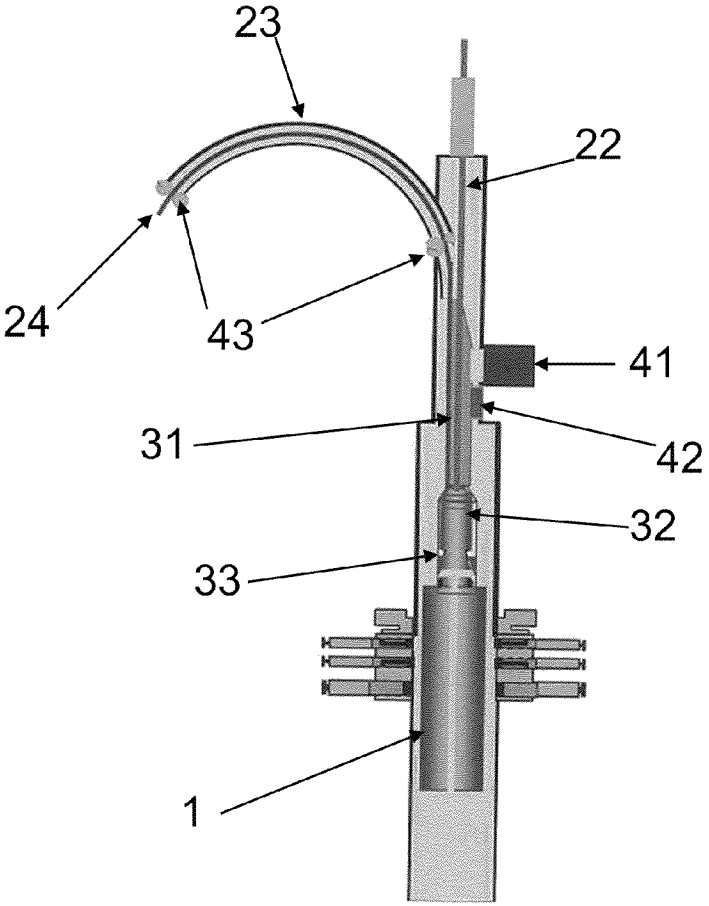
FIG. 9 shows connection of the BRC to the tool.

The wireline tool head 29*a* must be connected to the tool 1, after which, the deployment head 20 is secured to the well head 11, the pressure equalized 30 and the deployment rams opened (FIG. 8). Inside the deployment head 20, a section of tube 31 has been previously formed around the wireline cable 22, sealed and connected to a hydraulic latch 32. The hydraulic latch sub includes features 33 to mechanically latch and seal on the BHA 1. The BHA 1 can now be pulled up using the wireline cable 22 and latched to the hydraulic latch sub 32 (FIG. 9).

Figure 10:
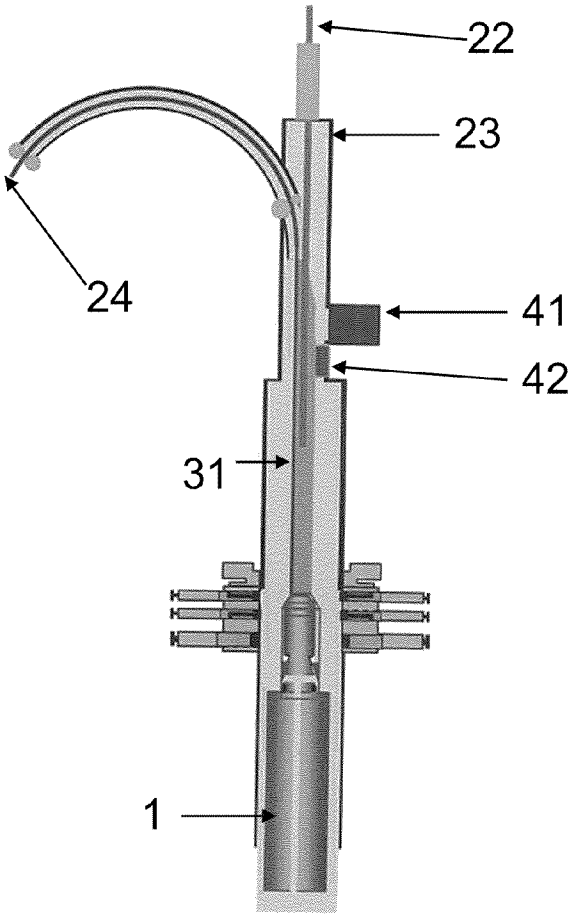
FIG. 10 shows lowering of the tool and BRC into the well.

Once the BRC 24 is securely connected to the BHA 1 the wireline cable 22 can be lowered, effectively pulling the BRC 24 through the pressure seal 23 (FIG. 10). As the BRC 24 is pulled through the pressure seal 23 it is sealed to form a pressure tight tube 31. The sealing mechanism 41 will vary with the type of BRC used. As the tube is formed a non-destructive test 42 such as ultrasound inspection can be used to confirm the integrity of the weld seam.

Alternatively the BRC can be pushed or pulled through the pressure seal using driver rollers 43. It is also possible that the BRC could be formed alongside the wireline cable 22 although this may require additional items to secure the BRC to the wireline cable. When the BRC is deployed such that the wireline cable runs through the center of the tube 31, the cable 22 provides mechanical support to the BRC. In particular the cable 22 restrains lateral movement thus providing excellent resistance to buckling or compressive mechanical loads.

In this manner any length of BRC may be deployed. The BRC may incorporate features at its proximal end to allow fluids to be expelled into the well bore. The BRC may also incorporate features at its proximal end that allow it to be efficiently retrieved. One preferred form of the invention is to only connect the BRC to the cable/tool at the distal end, thus the cable and BRC can be exposed independently to strain. If the BRC is fixed to the cable at the proximal end care must be taken to match the strains between the cable and the BRC, such that pulling on the cable does not damage the BRC.

Retrieving the BRC can be done in a variety of ways. The simplest form is to simply pull the wireline cable 22 back through the pressure control head, where the BRC is directed through a passage similar to the one that formed it. A water jet or knife can be used to slit the tube as it passes through the passage before the BRC passes through the pressure barrier.

Alternatively the BRC can be de-welded or de-constructed in a similar manner that was used to seal it. For example re-heating a welded area would allow the overlapping edges to be forced apart and subsequently expelled from the well through a pressure seal.

Creating a pressure seal around a BRC adds some complexity to the deployment head and creates a potential leakage path. The seal will also impose additional frictional forces on the BRC that must be accounted for. There is also the potential problem of closing the seal after deployment of the BRC and subsequently there is the problem of starting the BRC in the pressure seal for retrieval.

Figure 12:
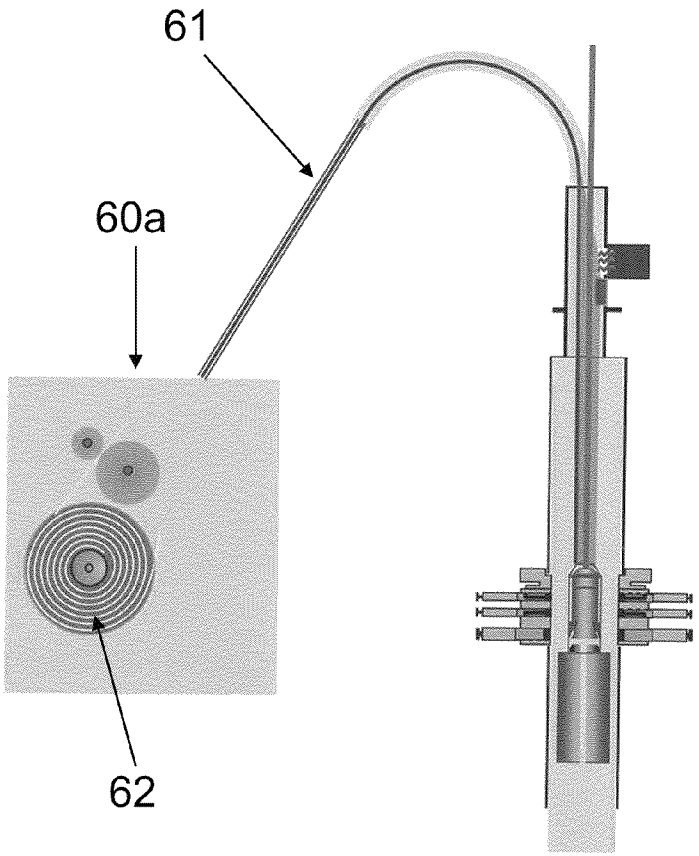
FIGS. 11 and 12 show alternative aspects of the invention.
Figure 11:
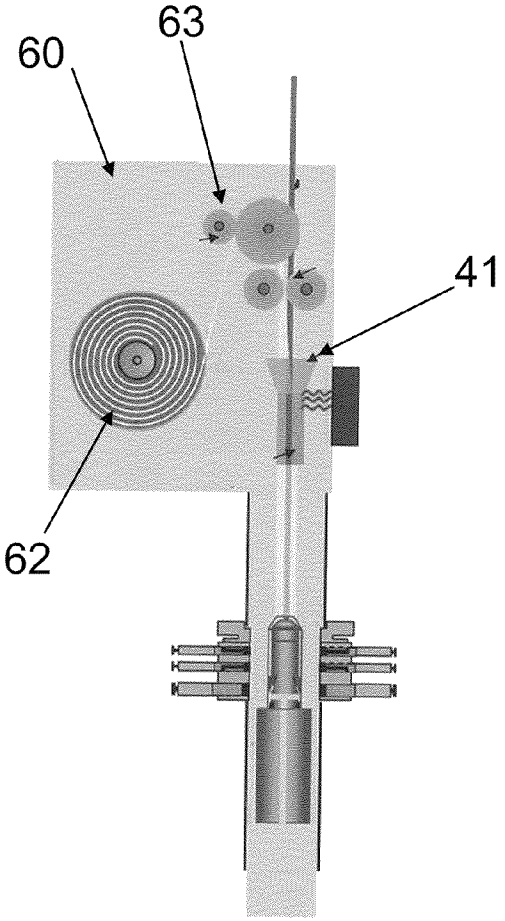

Potential solutions to these problems are shown in FIGS. 11 and 12. In FIG. 11, the deployment head is replaced by a pressure vessel 60 which encloses a reel 62 carrying the BRC in flat form and an arrangement of rollers 63 for directing the BRC around the cable and into the forming die 41. This eliminates the requirement for a dynamic seal around the BRC as it is fed into the borehole.

In FIG. 12, a separate pressure vessel 60*a* containing the coiled BRC 62 is positioned on the ground and connected through a pressurized tube or compliant guide 61 to the deployment head.

Further changes within the scope of the invention will be apparent.

The invention claimed is:

1. A method of forming a tubular conduit in a borehole, comprising:

closing the borehole by means of a pressure barrier configured to sustain a borehole pressure;

having at least one pressure sealable inlet through which a tool conveyance means can be inserted;

introducing a substantially flat, elongate flexible member through the pressure barrier and into the borehole; and forming the flexible member into a tubular conduit inside the borehole and below the pressure barrier adjacent the tool conveyance means.

2. The method as claimed in claim 1, further comprising progressively forming the tubular conduit as the flexible member is introduced into the borehole.

3. The method as claimed in claim 1, further comprising attaching an end of the tubular conduit to a tool located in the borehole suspended on an end of the conveyance means.

4. The method as claimed in claim 3, further comprising lowering the tool in the borehole on a conveyance means, and forming the tubular conduit around the tool conveyance means as the tool is lowered.

5. The method as claimed in claim 1, further comprising subsequently withdrawing the conduit from the borehole by opening the tubular tubular into a substantially flat form and withdrawing the substantially flat form from the borehole.

6. The method as claimed in claim 1, further comprising introducing the flexible member into the borehole through a pressure-sealable inlet.

7. The method as claimed in claim 1, further comprising providing a supply of the flat flexible member in an environment at borehole pressure that is connected to the borehole.

8. An apparatus for forming a tubular conduit in a borehole, the apparatus comprising:

a supply of a substantially flat, elongate flexible member;

a feed system for introducing the member through a pressure barrier and into the borehole, wherein the pressure barrier closes the borehole and is configured to sustain a borehole pressure, and wherein the pressure barrier has at least one pressure sealable inlet through which a tool conveyance means can be inserted; and a former below the pressure barrier for forming the flat member into a substantially tubular conduit in the borehole adjacent the tool conveyance means.

9. The apparatus as claimed in claim 8, wherein the former comprises a forming die that is exposed to borehole pressure.

10. The apparatus as claimed in claim 8, wherein the supply of the flexible member is exposed to borehole pressure.

11. The apparatus as claimed in claim 10, wherein the supply is enclosed in a chamber that also includes the former.

12. The apparatus as claimed in claim 10, wherein the supply is located in a housing at borehole pressure and connected to the borehole by means of a pressurised guide.

13. The apparatus as claimed in claim 8, further comprising a pressure sealable inlet for introducing the flat member into the borehole.

14. The apparatus as claimed in claim 8, further comprising a device configured to open or slit the tubular conduit into a substantially flat form in which it can be withdrawn from the borehole.

15. The apparatus as claimed in claim 8, wherein the former is arranged to form the tubular conduit around the tool conveyance means.

* * * * *